US010350738B2

(12) United States Patent
Sapp

(10) Patent No.: US 10,350,738 B2
(45) Date of Patent: Jul. 16, 2019

(54) OIL FILTER TOOL

(71) Applicant: Michael H. Sapp, Hilliard, OH (US)

(72) Inventor: Michael H. Sapp, Hilliard, OH (US)

(73) Assignee: Michael H. Sapp, Hilliard, OH (US)

( * ) Notice: Subject to any disclaimer, the term of this patent is extended or adjusted under 35 U.S.C. 154(b) by 322 days.

(21) Appl. No.: 15/204,019

(22) Filed: Jul. 7, 2016

(65) Prior Publication Data

US 2018/0009094 A1 Jan. 11, 2018

(51) Int. Cl.
*B25B 27/00* (2006.01)

(52) U.S. Cl.
CPC ..... *B25B 27/0042* (2013.01)

(58) Field of Classification Search
CPC ..... B25B 27/0042; B25B 13/481
See application file for complete search history.

(56) References Cited

U.S. PATENT DOCUMENTS 3,385,141 A 5/1968 Norman
4,266,452 A 5/1981 Crist
D264,614 S 5/1982 Johnson, Sr.
4,376,703 A 3/1983 Krauss
4,451,368 A 5/1984 Pandelena et al.
4,763,620 A 8/1988 Zastocki
4,865,727 A 9/1989 Krauss
4,867,017 A * 9/1989 Holman ..... B25B 27/0042 81/121.1
5,271,299 A 12/1993 Wadsworth
5,366,084 A 11/1994 Post
5,421,223 A 6/1995 Wawrzyniak
5,469,935 A 11/1995 Hewuse
6,227,078 B1 5/2001 Lemmo, Jr.
6,325,247 B1 12/2001 Iggulden
6,520,052 B1 * 2/2003 Saunders ..... B25B 13/52 81/3.43
6,769,516 B2 8/2004 Carlson
7,107,878 B1 9/2006 Jerantowski
7,147,013 B2 12/2006 Zulauf et al.
7,241,385 B1 7/2007 Cline
7,340,979 B2 * 3/2008 Sawyer ..... B25B 27/0042 81/120
2004/0226878 A1 11/2004 Higgins
2008/0276763 A1 11/2008 Greenberg

* cited by examiner

*Primary Examiner* — Joseph J Hail
*Assistant Examiner* — J Stephen Taylor
(74) *Attorney, Agent, or Firm* — Jason H. Foster; Kremblas & Foster

(57) ABSTRACT

An oil filter tool used to remove filters and mitigate spillage of oil during and after removal. Sidewalls with grooves between form a substantial cylinder. Curved walls form the grooves, extend outwardly from the sidewalls, and provide some flexibility in the tool's diameter, thereby permitting use with filters other than those for which the tool was designed. A floor is joined by the sidewalls and curved walls to define a chamber in which the filter is mounted. A finger limits insertion of the filter to define a gap into which oil can flow. A funneling guide is angled at the end of the sidewalls opposite the floor to guide oil into the chamber. At least one of the grooves is closed at the guide end and there is an aperture to permit air flow out of the chamber.

8 Claims, 6 Drawing Sheets

OIL FILTER TOOL

BACKGROUND OF THE INVENTION

The invention relates generally to devices for oil filter removal, and more specifically to a cylindrically-shaped structure that is used to aid in removing the filter and to catch oil that leaks from an oil filter during replacement.

Automobile and other internal combustion engines have oil filters that must be replaced periodically. When the filter is replaced, it must be removed from the engine with an appreciable amount of oil remaining within it. Numerous factors, such as whether the filter's axis is tilted and whether surrounding structures permit easy hand or tool placement around the filter, determine whether the filter may be removed readily and/or will spill some or all of the oil during removal.

Most automobile oil filters have a cylindrical outer housing and a threaded cylindrical barrel extending into it. The threaded barrel receives an externally threaded tube that extends from the engine with a passageway through the tube. By rotating the filter around the threaded tube, the filter is screwed onto or off of the engine in the manner of a nut that is screwed onto or off of a bolt. A gasket, such as a rubber ring, typically encircles the opening on the filter to seat against the engine and seal the juncture of the filter and the engine.

When a new oil filter is ready to be installed, it is empty and poses no spill risk. However, when the filter has reached the end of its useful life, the filter's cylindrical housing is full of oil. Removal typically takes place by rotating the filter relative to the engine, which thereby un-screws the filter from the threaded tube to permit removal. However, any oil in the filter may spill out of the filter's opening during removal and before the filter can be tilted to a vertical orientation in which the filter opening is pointed upwardly so that spillage cannot occur. Furthermore, if the filter has remained in position for an extended period or there is corrosion present, the filter may be difficult to rotate, particularly if the mechanic attempting removal cannot grasp the filter with his or her entire hand. Grasping may be difficult if the components around the filter prevent rotating of the filter with the require force. This difficulty in rotating may be exacerbated by any oil or other residue that has found its way to the outer surface of the filter housing, because such oil provides a lubricant to prevent a tight hand-grip on the filter.

There are many tools that permit a user to more tightly grip the oil filter to ease rotation of the same. However, such tools require substantial space around the filter to install and use. Furthermore, such tools do little to nothing to prevent oil spillage. Other devices, which are referenced in the Invention Disclosure Statement (IDS) filed herewith, fit around oil filters to ease in gripping the same and attempt to catch some or all oil that spills during removal. Nevertheless, such prior art devices fail to provide the necessary features that are required to remove most or all filters with little to no oil spillage.

BRIEF SUMMARY OF THE INVENTION

Disclosed herein is a tool used with substantially cylindrical oil filters. The tool permits ready removal of the filter from an engine, and concurrently retains any oil that may drip or pour from the engine or oil filter. This is effected by a generally cup-shaped vessel made of preferably flexible and generally soft material, which may be an elastomer that has a durometer between about 20 and about 80 on the Shore 00 scale. The vessel has an angled guide that forms its rim that directs oil into the chamber of the vessel. Furthermore, the sidewalls have channels formed therein that form passages along the sidewalls of the filter. These permit any oil that flows out of the filter or the engine to be guided into a chamber within the tool rather than spilling onto the ground, the automobile or the mechanic.

The material of which the tool is made is flexible and high-friction, and the channels permit flexure of the tool. Therefore, the tool aids in removal of many different sizes of filters, even ones that are slightly larger than the tool. This results from, as the tool is placed over the filter, the tool stretching to fit over the filter, thereby providing a superior surface for grasping and rotating. Furthermore, some materials contemplated provide a thermal barrier for the user so a user's fingers are not burned on a hot oil filter.

Figure 1:
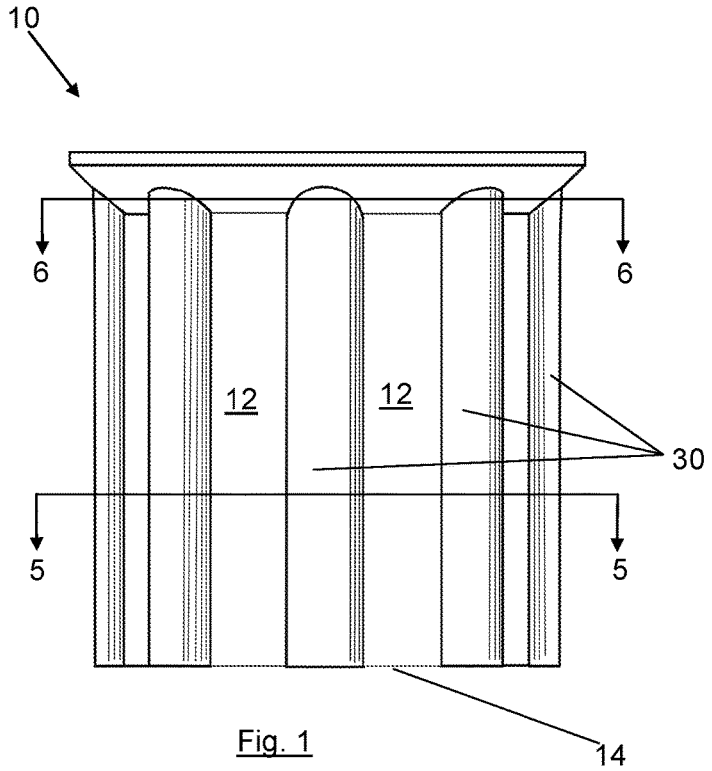
FIG. 1 is a side view illustrating an embodiment of the present invention.
Figure 2:
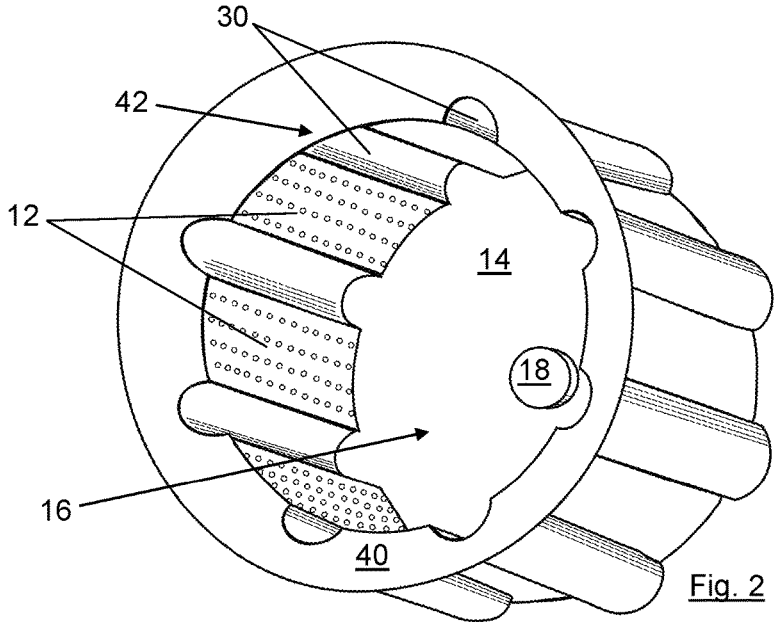
FIG. 2 is a view in perspective illustrating the embodiment of FIG. 1.
Figure 3:
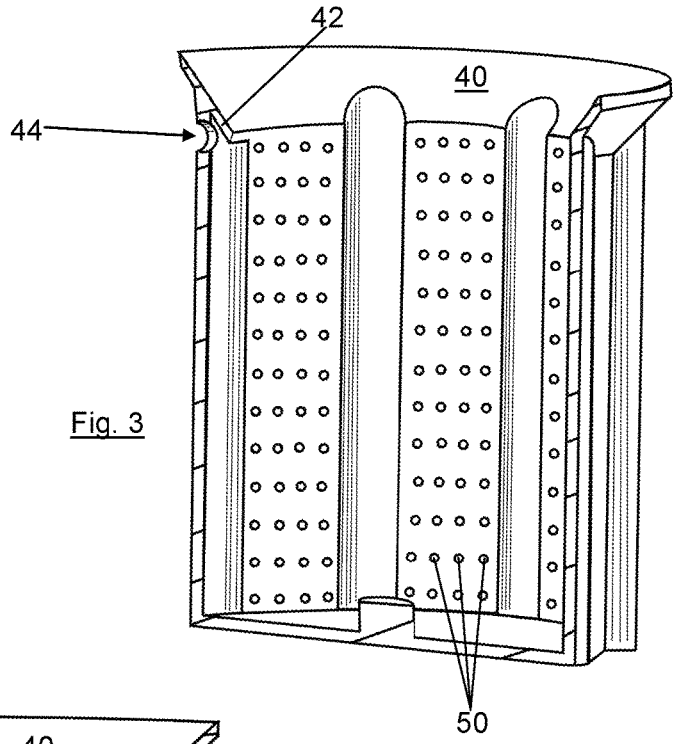
FIG. 3 is a section view in perspective illustrating the embodiment of FIG. 8 through the line 3-3.
Figure 4:
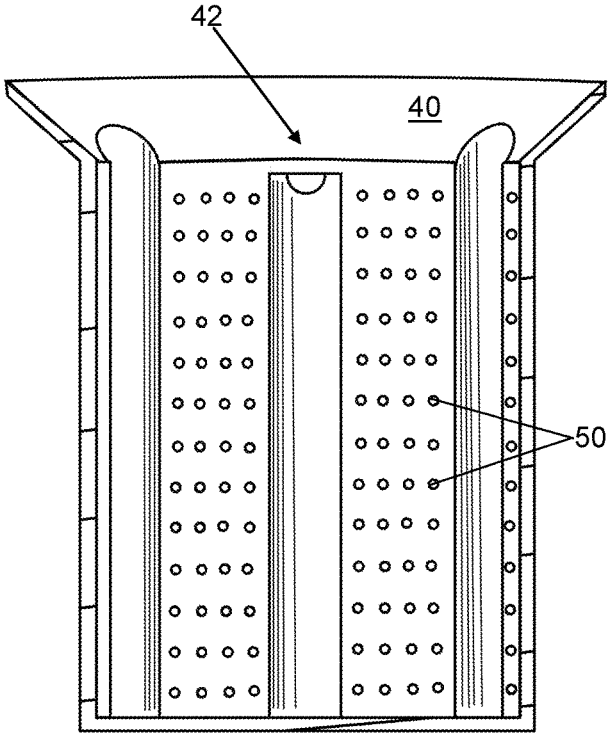
FIG. 4 is a side view in section illustrating the embodiment of FIG. 8 through the line 4-4.
Figure 5:
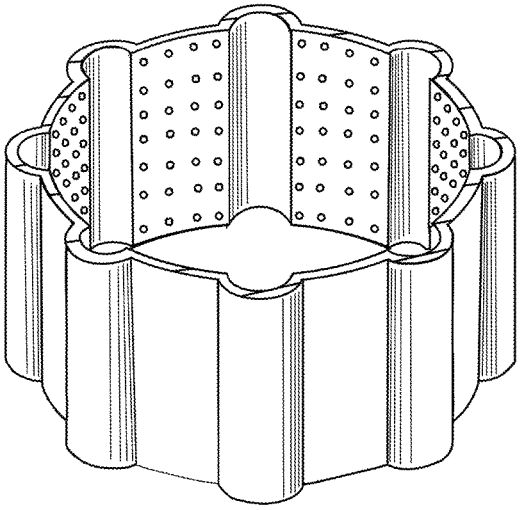
FIG. 5 is a section view in perspective illustrating the embodiment of FIG. 1 through the line 5-5.
Figure 6:
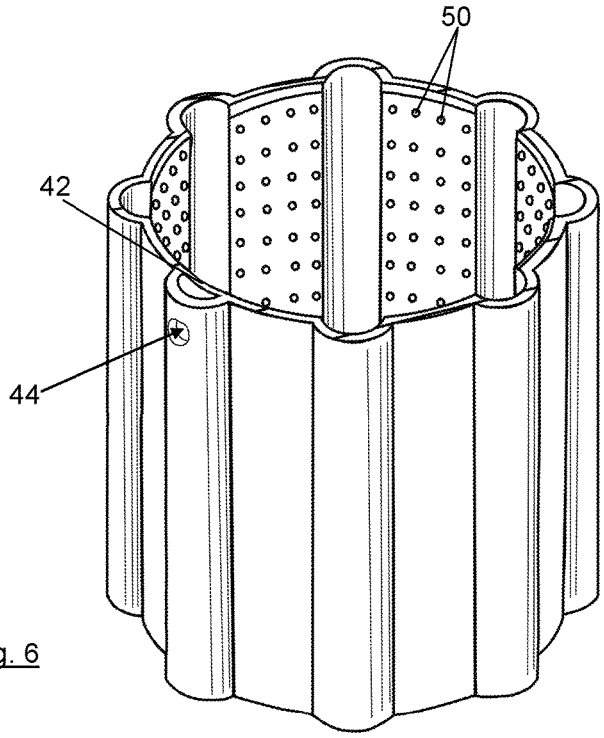
FIG. 6 is a section view in perspective illustrating the embodiment of FIG. 1 through the line 6-6.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

The tool 10 is shown in FIGS. 1-8 in various embodiments and perspectives. The tool 10 has sidewalls 12 and a floor 14, and is preferably made of a flexible, high-friction material, such as silicon, neoprene, rubber, fluoro rubber, or a fluoroelastomer, and can withstand exposure to petroleum products and temperatures of 200° F. or more. The sidewalls 12 and floor 14 are transverse to each other at their juncture, and are preferably perpendicular or substantially perpendicular (within a few degrees of perpendicular, plus or minus a few degrees from 90 degrees) to each other at their juncture.

The sidewalls 12 extend around and join to the floor 14 at or near the periphery of the substantially circular floor 14, and thus define a substantially circular cylindrical wall. The substantially cylindrical wall desirably cooperates with a substantially cylindrical wall of a conventional oil filter 100, shown schematically in an operable position in FIG. 7. During use, the tool 10 receives the oil filter 100 into a chamber 16 defined by the void within the joined sidewalls 12 and floor 14. The radially inwardly facing surfaces of the sidewalls 12 contact, or are in very close proximity to, the radially outwardly facing surface of the filter 100 sidewall.

Figure 7:
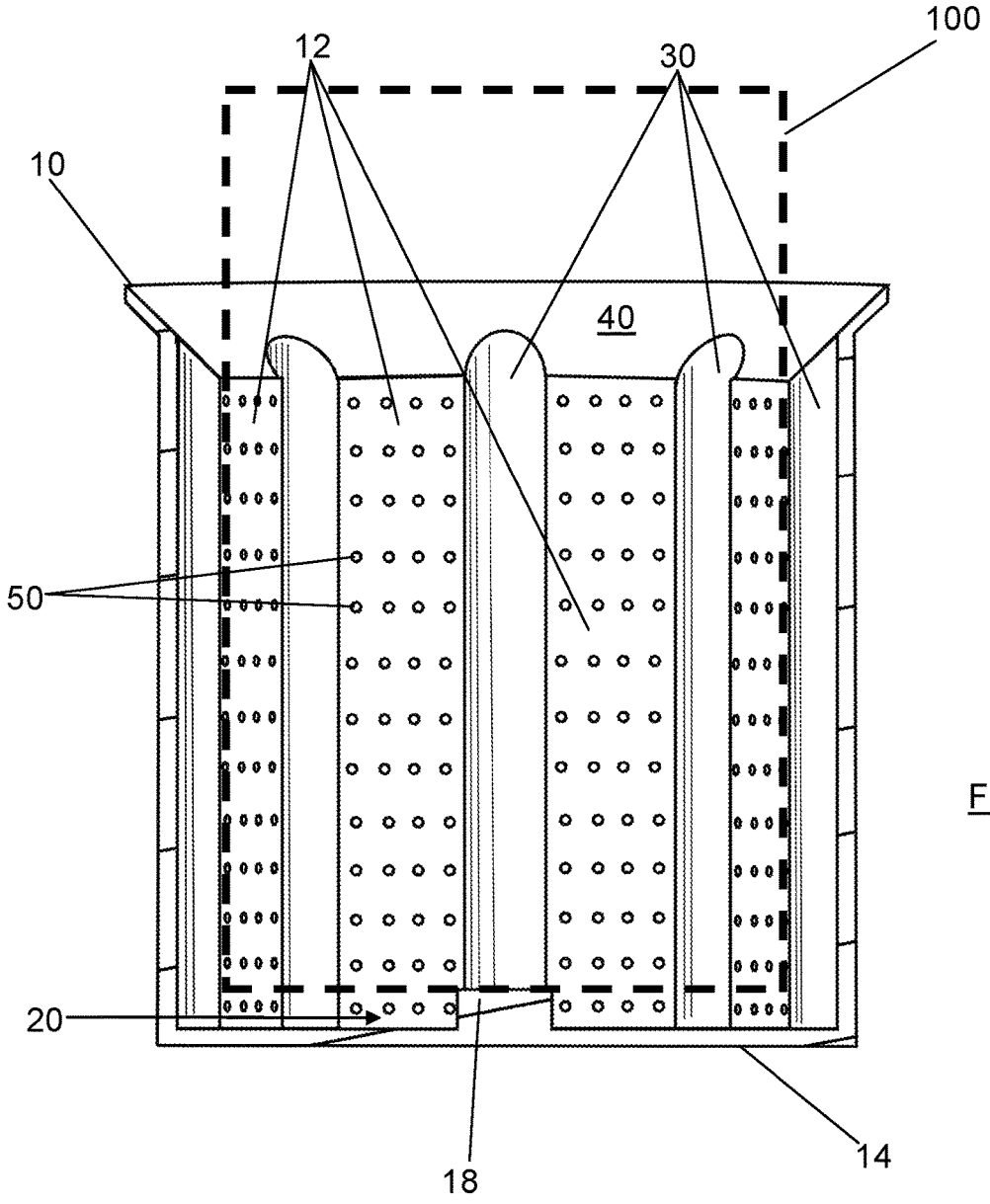
FIG. 7 is a side view in section illustrating the embodiment of FIG. 8 through the line 7-7.

When the filter 100 is in the operable position shown in FIG. 7, a sub-chamber 20 is formed at the lower end of the tool 10 adjacent the floor 14. A finger 18 is mounted to the floor 14 and extends toward the opening of the tool 10 a predefined distance, which may be about one-tenth the height of the sidewalls 12, and this may be about one centimeter for a typical size tool 10. The finger 18 is preferably a solid piece of the same material that the entirety of the tool 10 is made of, which allows the tool 10 to be cast, injection molded or otherwise formed of a single piece of material. The finger 18 is preferably a cylinder that is integral with the floor 14 and protrudes therefrom, preferably along an axis parallel to the sidewall 12. The finger 18 resists insertion of the oil filter 100 into the chamber 16 more than a permitted amount, thereby defining the sub-chamber 20 within the gap formed between the floor 14 and the end of the filter 100 that is farthest in the chamber 16. This sub-chamber 20 is where oil can be retained as described in more detail below.

There are preferably multiple groovewalls 30 formed between each of the sidewalls 12, preferably integral with the sidewalls 12 at their lateral edges. The groovewalls 30 are preferably semi-cylindrical, elongated bodies that have the same height as the sidewalls 12, but protrude radially outwardly from the sidewalls 12. The inner surfaces of the sidewalls 12 form a substantially cylindrical surface that corresponds to, and preferably is the same shape as, the oil filter's 100 substantially cylindrical outer wall, and passages are formed between the filter's wall and the groovewalls 30 through which oil may flow. Thus, each groovewall 30 allows the passage of any oil or other liquid through the voids defined between the groovewalls 30 and the oil filter's outer wall. The voids defined between the groovewalls 30 and the oil filter's outer wall are in fluid communication with the sub-chamber 20, and therefore any oil that flows into these voids may be carried, by the force of gravity or any other force, into the sub-chamber 20.

The groovewalls 30 also permit flexure of the tool 10 to permit radial expansion. This permits the tool 10 to receive filters of a larger diameter than would be suggested by the diameter of the substantially cylindrical surface that corresponds to the inner surfaces of the sidewalls 12. Thus, if the diameter measured at the interior of the sidewalls 12 is exactly 7.0 centimeters, the tool 10 could accommodate a filter of at least 8.0 centimeters, and possibly larger. Upon insertion of the filter into the tool 10, the groovewalls 30 expand to a larger radius to permit the sidewalls 12 to expand outwardly.

An angled guide 40 extends outwardly from the sidewalls 12 and groovewalls 30 to guide any oil that flows down the side of the oil filter's wall inwardly toward the sidewalls 12 and groovewalls 30 of the tool 10. Once the oil reaches a groovewall 30, it has a direct flow path to the sub-chamber 20, where oil preferably flows to be retained for subsequent disposal. The angled guide 40 is preferably oriented at an angle of between about 30 and about 60, and preferably about 45, degrees relative to the cylindrical exterior wall of the filter 100. The angled guide 40 protrudes radially about 10-20 percent of the diameter of the tool 10, which may be about 1-2 centimeters for a typical tool 10. This permits a sufficiently wide guide 40 to catch oil and direct it into the voids defined by the groovewalls 30, but not extend so far radially that it interferes substantially with the positioning and use of the tool 10.

When considering the oil filter 100, which is shown schematically in FIG. 7 in a vertical orientation, any oil that flows over the right (in the FIG. 7 illustration) side of the filter 100 may not flow past the guide 40, but instead is directed into the passage defined by the groovewall 30 and the exterior wall of the oil filter 100. This oil then flows by gravitational force down the exterior wall of the filter 100 and into the sub-chamber 20. Therefore, when the tool 10 is in use, the user grasps around the sidewalls 12 and groovewalls 30 using his or her hand, and, after squeezing the tool's outer surface, rotates the combination of the tool 10 and the filter 100, thereby loosening the filter from the attaching structures. When oil that is within the oil passages of the engine, the filter and any other region, flows out toward the edge of the filter 100, the oil preferably flows under the force of gravity toward the guide 40. The guide 40 then directs the oil into the voids defined by the guidewalls 30 and the filter's sidewall, thereby preventing spills and encouraging storages of the oil.

Figure 8:
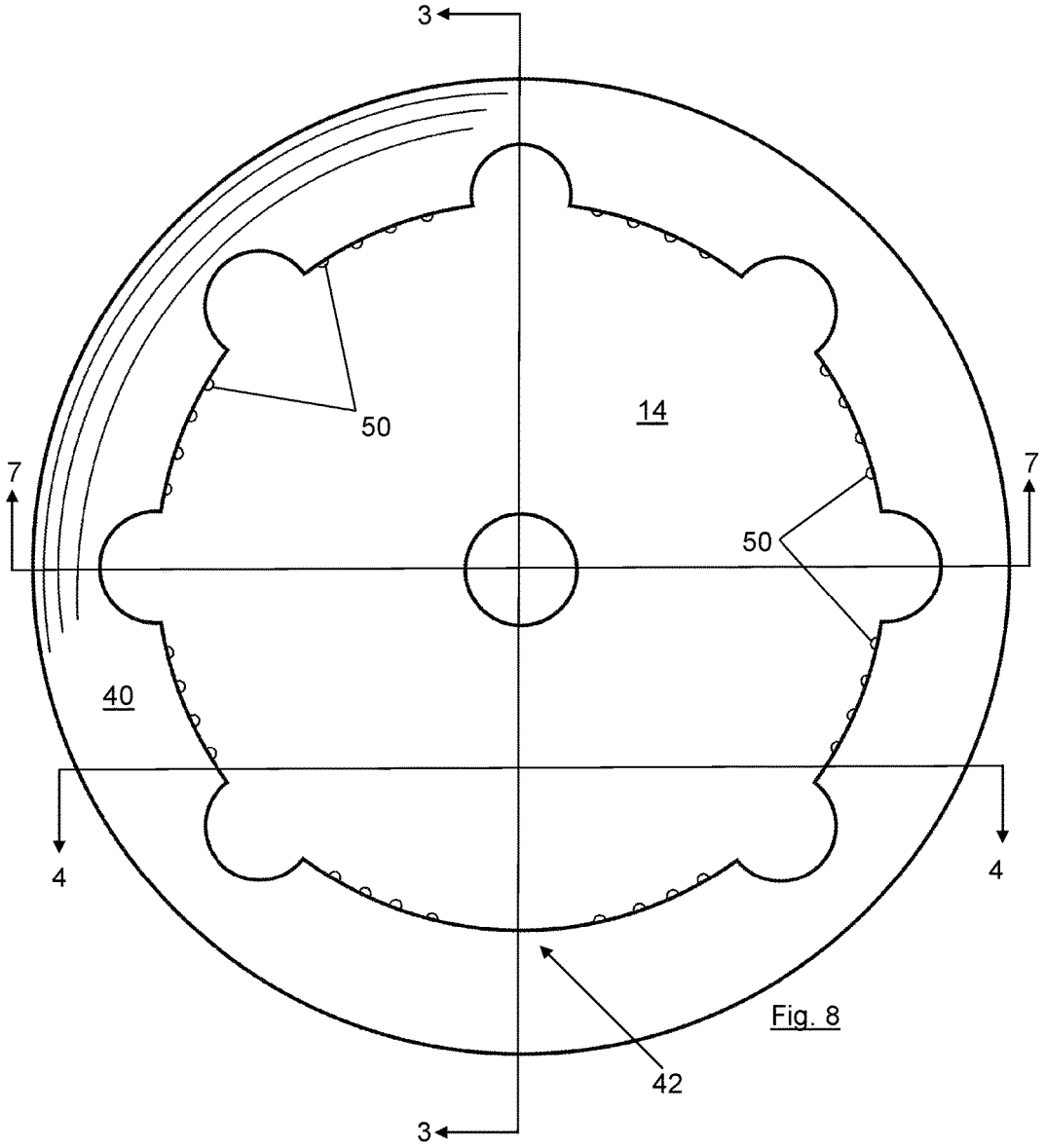
FIG. 8 is a top view illustrating an embodiment of the invention.
Figure 9:
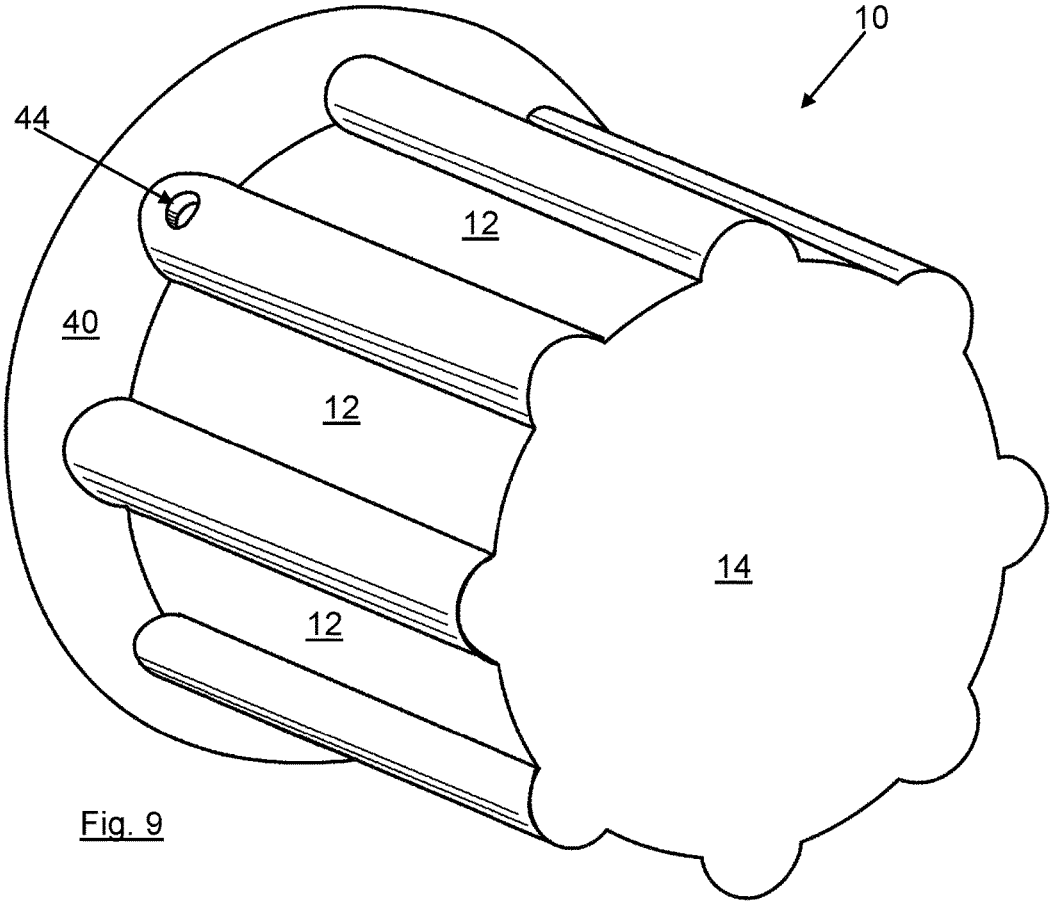
FIG. 9 is a view in perspective illustrating the embodiment of FIG. 1.

The tool's sidewalls 12, as shown in FIG. 8, preferably have small protrusions 50 extending radially inwardly therefrom. The protrusions 50 are preferably semi-spherical, and have their bases attached to the sidewalls 12, preferably by being formed integrally with the sidewalls 12. The protrusions 50 are aligned in rows and columns as shown in the illustrations, and preferably are formed anywhere the filter's 100 radially outwardly-facing wall contacts the tool 10. The protrusions 50 are shown to extend into the region that defines the sub-chamber 20, but this is not necessary because no filter ordinarily contacts the tool 10 at this region of the sidewalls 12. Preferably no protrusions 50 are formed in the groovewalls 30, but protrusions 50 may be formed in the groovewalls 30.

The protrusions 50 perform at least two functions. First, because the material of which the entire tool 10 is preferably made is a high-friction elastomer, the protrusions 50 form seating surfaces that contact the oil filter's cylindrical exterior wall whenever the oil filter 100 is in, or is being inserted in or removed from, the chamber 16. This means that during insertion and removal of the oil filter, preferably only the protrusions 50, and possibly only the tips of some of the protrusions 50, contact the oil filter 100. This represents a smaller surface area in contact with the filter 100 than without the protrusions 50, thereby reducing the resistance to sliding the oil filter 100 into, and out of, the tool 10 under the same amount of pressure. Without the protrusions 50, insertion and removal of the filter would be more difficult due to a larger surface area of contact that the oil filter would have against the sidewalls 12.

The second function of the protrusions 50 results when the tool 10 is squeezed on the oil filter 100. The protrusions 50 are so small that, under the amount of force that can be applied by a human hand, they compress into the sidewalls 12 and allow essentially the entire surface area of the sidewalls 12 to contact the oil filter 100. When this occurs, this promotes enhanced friction between the tool 10 and the filter 100, which enhances grip when it is most desired—when the filter is to be rotated for removal. Therefore, the protrusions 50 reduce friction when friction is desirably low during insertion of the filter into, or removal from, the chamber 16. The protrusions 50 also increase friction when friction is desirably high during gripping of the filter for rotation and removal.

At least one of the groovewalls 30 has a feature that will now be described. Because oil is a thick liquid and is incompressible, the presence of oil in all groovewall 30 passages simultaneously could prevent oil from flowing into the sub-chamber 20. As the oil flows toward the sub-chamber 20, it must displace air. If there is no passage to allow the displaced air to escape, oil flow may stop. Therefore, there must be a passage for air to escape from the sub-chamber 20 so that the sub-chamber 20 can accommodate oil. To prevent all passages from being blocked, a guide extension 42 is formed. The guide extension 42 is essentially a continuation of the guide 40 across the end of one groovewall 30. The extension 42 at least reduces, and preferably prevents, oil from flowing into the passage formed by the groovewall 30 that is blocked by the extension 42. An aperture 44 is also formed in the groovewall 30 adjacent the extension 42 to permit the air displaced by the oil entering the sub-chamber 20 to escape outside of the tool 10. This combination of features allows air to flow through the covered passage as the air is displaced by oil in the other passages defined by the remaining groovewalls 30.

The sub-chamber 20 is in fluid communication with all passageways defined by the groovewalls 30. When air or another gas that is displaced by oil flowing through the passageways defined by open-ended groovewalls 30, the groovewall 30 that is blocked by the extension 42 remains substantially free of flowing oil. Therefore, air in the sub-chamber 20 may flow through the passage defined by this particular groovewall 30 and exit the tool 10 through the aperture 44.

The tool 10 operates in a preferred manner as will now be described. First the chamber 16 of the tool 10 is aligned with the oil filter, and the oil filter is preferably slightly larger in diameter than the tool's 10 sidewalls 12. The tool 10 is then manually extended over the filter 100 to the position shown in FIG. 7, in which the filter 100 is inserted into the chamber 16 until its bottom (in the orientation shown in FIG. 7) surface seats against the finger 18. During insertion, the protrusions 50 slide against the cylindrical wall of the filter 100, thereby allowing ease of insertion of the filter 100 into the chamber 16, and the groovewalls 30 permit radial expansion of the tool 10 in the manner of a bellows. Once this position is achieved, the user may grasp the tool 10 with his or her hand (thumb in an arc circumferentially around one side and fingers in an arc around the opposite side) and squeeze. By squeezing, the protrusions 50 are smashed into the remainder of the sidewall 12 material and become effectively part of the sidewall's 12 smooth surface. This provides substantial friction between the sidewall 12 and the filter's cylindrical sidewall as the grasping hand effects a torsional force on the tool 10. This torsional force rotates the filter and tool 10 combination about the axis of rotation of the threaded shaft known to the person of ordinary skill, thereby beginning the process of removal of the filter 100.

Once the seal between the filter 100 and the engine is broken, any oil in the system can begin to flow over the top end (in the FIG. 7 orientation) of the filter 100 and flow down the side of the filter. Such oil encounters the angled guide 40, which acts like a funnel's angled walls and directs the oil radially inwardly into any space between the filter's cylindrical sidewall and the tool 10, preferably into the voids between the filter's sidewall and the groovewalls 30. The oil then flows downwardly into the sub-chamber 20 where it is retained until proper disposal. After the filter 100 is removed from the engine, the filter is then manually removed longitudinally from the tool 10 after any oil in the filter and the tool 10 is poured into a proper receptacle. When the user removes the filter from the tool 10, the user is not grasping the tool 10 in the manner used for rotating the filter and tool. Therefore, the protrusions 50 have expanded radially inwardly and thereby permit the filter to slide easily relative to the tool 10. The tool 10 may then be placed in an empty oil pan or disposal container so that all oil can drip therefrom so the tool 10 is ready for its next use.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An oil filter tool for removing substantially cylindrical oil filters, the tool comprising:

(a) at least first and second sidewalls defining a substantially cylindrical curve around an axis, the sidewalls disposed radially from the axis at a sidewall position, wherein the first and second sidewalls are spaced from one another to form first and second gaps;

(b) at least first and second groovewalls mounted in the first and second gaps, respectively, to edges of the first and second sidewalls, the groovewalls extending radially outwardly from the sidewall position;

(c) an angled guide joined to a tool-opening end of the sidewalls and groovewalls and extending radially outwardly therefrom, the angled guide being for guiding liquid toward at least the groovewalls, the angled guide having an opening at a tool-opening end of at least the second groovewall, the opening extending radially from the sidewall position to the second groovewall, the angled guide also having an angled guide extension extending radially to the first groovewall from the sidewall position over the tool-opening end of the first groovewall, and a radially-extending aperture is formed through the first groovewall adjacent the angled guide extension for passage of air out of the tool; and (d) a floor joined to an axially opposite floor end of the sidewalls and the groovewalls.

2. The oil filter tool in accordance with claim 1, further comprising a plurality of protrusions formed on the sidewalls and extending radially inwardly.

3. The oil filter tool in accordance with claim 1, further comprising a finger mounted to the floor and extending toward the tool-opening end, whereby a filter inserted into the tool-opening end seats against the finger and defines a sub-chamber between the floor and the filter.

4. The oil filter tool in accordance with claim 1, further comprising third and fourth sidewalls, spaced from one another to form third and fourth gaps and third and fourth groovewalls mounted in the third and fourth gaps, respectively.

5. An oil filter tool in combination with a substantially cylindrical oil filter, the combination comprising:

(a) a plurality of sidewalls defining a substantially cylindrical curve around an axis, the sidewalls disposed radially from the axis at a sidewall position, wherein the sidewalls are seated against a substantially cylindrical, radially outwardly-facing filter wall, and are spaced from one another to form a plurality of gaps;

(b) a plurality of groovewalls, each groovewall mounted in a corresponding one of the gaps to edges of the sidewalls, the groovewalls extending radially outwardly from the sidewall position at least a first of the groovewalls having a radially-extending aperture extending therethrough for passage of air out of the tool, wherein the groovewalls extend along the filter wall and define elongated voids along the filter wall;

(c) an angled guide joined to a tool-opening end of the sidewalls and groovewalls and extending radially outwardly, the angled guide being for guiding liquid toward at least the groovewalls, the angled guide having an angled guide extension extending radially to the first groovewall from the sidewall position over the tool-opening end of the first groovewall and having an opening at a tool-opening end of at least a second of the groovewalls, the opening extending radially from the sidewall position to the second groovewall; and (d) a floor joined to an axially opposite floor end of the sidewalls and the groovewalls.

6. The combination in accordance with claim 5, further comprising a plurality of protrusions formed on the sidewalls and extending radially inwardly and seating against the filter wall.

7. The combination in accordance with claim 5, further comprising a finger mounted to the floor and extending toward a mouth defined by the angled guide, wherein the filter seats against the finger and defines a sub-chamber between the floor and the filter, and wherein a fluid passage is formed between the sub-chamber and the aperture.

8. An oil filter tool for removing substantially cylindrical oil filters, the tool comprising:

(a) at least first and second sidewalls defining a substantially cylindrical curve around an axis, the sidewalls disposed radially from the axis at a sidewall position, wherein the first and second sidewalls are spaced from one another to form first and second gaps;

(b) at least first and second groovewalls mounted in the first and second gaps, respectively, to edges of the first and second sidewalls, the groovewalls extending radially outwardly from the sidewall position;

(c) an angled guide joined to a tool-opening end of the sidewalls and groovewalls and extending radially outwardly therefrom, the angled guide being for guiding liquid toward at least the groovewalls, the angled guide having an opening at a tool-opening end of at least the second groovewall, the opening extending radially from the sidewall position to the second groovewall, the angled guide also having an angled guide extension extending radially to the first groovewall from the sidewall position over the tool-opening end of the first groovewall; and (d) a floor joined to an axially opposite, floor end of the sidewalls and the groovewalls.

* * * * *